US008006962B2

(12) United States Patent
Jursich

(10) Patent No.: US 8,006,962 B2
(45) Date of Patent: Aug. 30, 2011

(54) HUMIDIFIER WITH LOUVERED AIR INTAKE

(75) Inventor: Donald N. Jursich, Crystal Lake, IL (US)

(73) Assignee: RPS Products, Inc., Hampshire, IL (US)

( * ) Notice: Subject to any disclaimer, the term of this patent is extended or adjusted under 35 U.S.C. 154(b) by 839 days.

(21) Appl. No.: 12/047,606

(22) Filed: Mar. 13, 2008

(65) Prior Publication Data

US 2009/0230574 A1 Sep. 17, 2009

(51) Int. Cl.
*B01F 3/04* (2006.01)

(52) U.S. Cl. ..... 261/102; 261/105; 261/DIG. 15

(58) Field of Classification Search ..... 261/100, 261/102, 105, DIG. 15; 126/113
See application file for complete search history.

(56) References Cited

U.S. PATENT DOCUMENTS 3,090,179 A * 5/1963 Powell ..... 96/294
3,209,744 A * 10/1965 Ayres et al. ..... 126/113
3,355,155 A * 11/1967 Heltzen et al. ..... 261/130
3,738,621 A * 6/1973 Anderson ..... 261/29
3,770,254 A * 11/1973 Morrow ..... 261/105
3,823,926 A * 7/1974 Bracich ..... 261/106
5,368,784 A 11/1994 Annestedt, Sr.
6,572,085 B2 * 6/2003 Bloemer ..... 261/97

* cited by examiner

*Primary Examiner* — Frank M Lawrence
(74) *Attorney, Agent, or Firm* — Greer, Burns & Crain, Ltd.

(57) ABSTRACT

A humidification system includes a housing mountable into an air duct, that includes a base frame, a cover and at least one open end panel. The base frame is mountable to an opening in the air duct that is shaped and configured to align with the base frame. The cover attaches to the base frame with the open end panel between the base frame and cover. The air outlet is through the open end panel. An evaporative element is positioned between the air inlet and air outlet. Controlling humidity output provides moisture to the evaporative element when needed. The bypass frame includes louvers that are positioned within the air inlet, where the louvers are sized to extend into the air duct. The louvers are graduated in size. After passing through the housing, an air return directs humidified air from the open end panel to a low pressure air duct.

13 Claims, 3 Drawing Sheets

HUMIDIFIER WITH LOUVERED AIR INTAKE

FIELD OF THE INVENTION

The present invention relates to humidifiers, particularly humidifiers for hot air furnaces and heating systems. More specifically, the instant humidifier has increased air flow through it without the use of a fan.

BACKGROUND OF THE INVENTION

Humidifiers for hot air furnaces and space heating systems are typically comprised of a housing having an air inlet and an air outlet for passing space heating air from the furnace through the housing and over and/or through a water fed evaporator in the housing for moistening the heating air passing through the housing and to the space heating system. The structure, mode of operation and beneficial effects of hot air furnace humidifiers are well known.

A typical bypass humidifier to be used in association with a hot air furnace includes warm or hot air supply ducting, cool or cold air return ducting and an internal blower for forcing heated air from the furnace through the ducting. The humidified air is forced to a space to be heated. Cool air from the space is pulled or drawn through the ducting back to the furnace to be reheated and re-circulated through the space. A bypass humidifier has an inlet in its back wall connected in fluid communication with one or the other of the ducts, usually the hot air supply ducting, and an outlet connected in fluid (gaseous) communication with the other of the ducts, usually the cool air return ducting. Due to the differential between the relatively higher pressure airflow in the supply ducting and the relatively lower pressure airflow in the ducting, air is induced to flow from the supply ducting through the humidifier to the return ducting, thereby causing air to flow over and/or through an evaporator unit in the housing to moisturize, i.e., humidify, the air flowing through the space heating system. A damper installed at the outlet of the humidifier controls the amount of air passing through the humidifier and thus the amount of moisturized air delivered to the space to be heated.

U.S. Pat. No. 5,368,784 suggests a method of improving air flow through the humidification system by placing a scoop inside the air duct so that pressure from the flowing air can be harnessed to push dry air through the humidifier. Air is forced into the humidification system, through an evaporative element, then turned 180° to exit back through the evaporative element and exits via an outlet back into the air duct. This improvement provides continuous humidification and requires only a single opening in the air duct for installation, it is not an efficient humidifier. Passing the humidified air back through the evaporative element actually reduces the amount of moisture that can be held by the humidified air. While absorbing moisture on the first pass through the evaporative element, heat from the hot air is used to generate the latent heat of vaporization of the water. The hot air is further cooled as it continues through the housing and reverses direction. Therefore, as it passes through the evaporative element just prior to exiting the humidifier, the air is cooler than it was as it passed through the evaporative element the first time. Since the air has cooled, it has less capacity to hold moisture, and is thus likely to deposit water in the evaporative element rather than absorb it.

Another disadvantage of this humidifier is that it utilizes only about half of the evaporative element to put water into the air. The hot air comes in the scoop and is directed only toward the bottom half of the evaporative pad. After reversing direction in the space between the pad and the cover, the air flows through the top half of the evaporative pad. Since the top half of the evaporative element is substantially ineffective for putting water into the air, only about half of the surface area of the evaporative element is effectively being used.

SUMMARY OF THE INVENTION

The present invention is an improved humidification system that more efficiently utilizes the evaporative element. More specifically, the humidification system includes a housing mountable into the air duct. The housing includes a base frame, a cover and at least one open end panel, where the base frame is mountable to an opening in the air duct that is shaped and configured to align with said base frame. Air is encouraged to flow of from an air inlet to an air outlet by the shape and configuration of the cover. The cover is attachable to the base frame with the open end panel is positionable between the base frame and the cover. The air outlet is included in the open end panel. An evaporative element is positioned between the air inlet and the air outlet. A means for controlling humidity output provides moisture to the evaporative element when needed.

A bypass frame includes a plurality of louvers that are positioned at least partially within the air inlet, where the louvers being sized and configured to extend at least partially into the air duct. The louvers are graduated in size so that the length of the louvers increases in the direction of the air flow. After passing through the housing, an air return directs humidified air from the open end panel to a portion of an air duct at a lower pressure than the air inlet.

The pressure differential within the furnace is utilized to push unhumidified air through the humidification system without the need for an additional fan. In most systems, the fan in a forced air furnace creates sufficient pressure to create air flow through the humidification system as well as the furnace ducts. Energy savings is realized compared to humidification systems that need an additional fan to ensure air flow through the humidifier.

Efficiency of use of the evaporative element is also improved compared to some of the prior art. The evaporative element is efficiently utilized due to the louvers that direct portions of the incoming air through various regions of the evaporative element. Further, it is not necessary to reserve a portion of the outgoing humidified air, since only unhumidified air passes through the evaporative element.

DETAILED DESCRIPTION OF THE DRAWINGS

DETAILED DESCRIPTION OF THE INVENTION

Figure 1A:
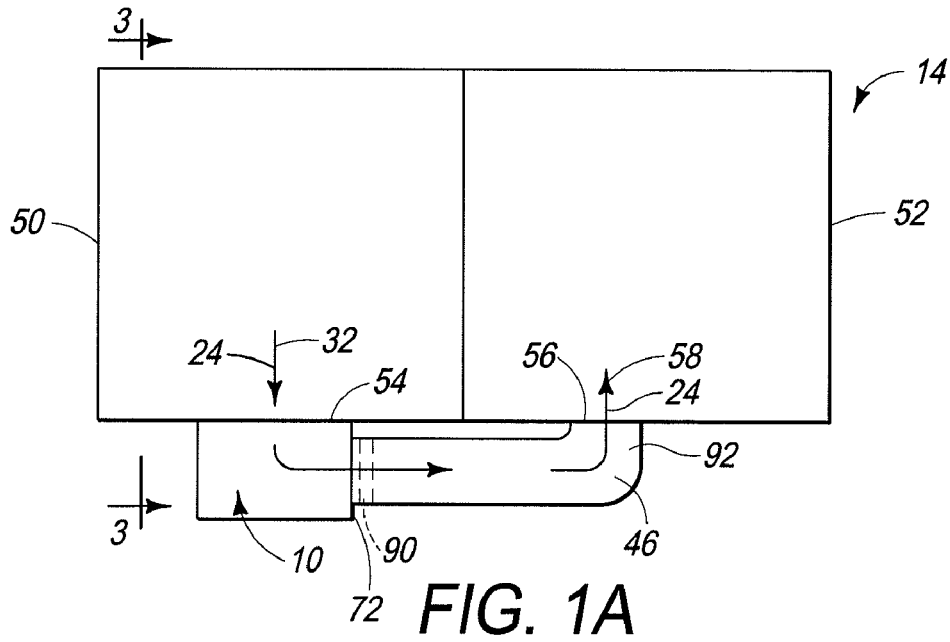
FIG. 1A is a top view, schematic drawing of the humidification system of the present invention installed for use on a forced air furnace.
Figure 1B:
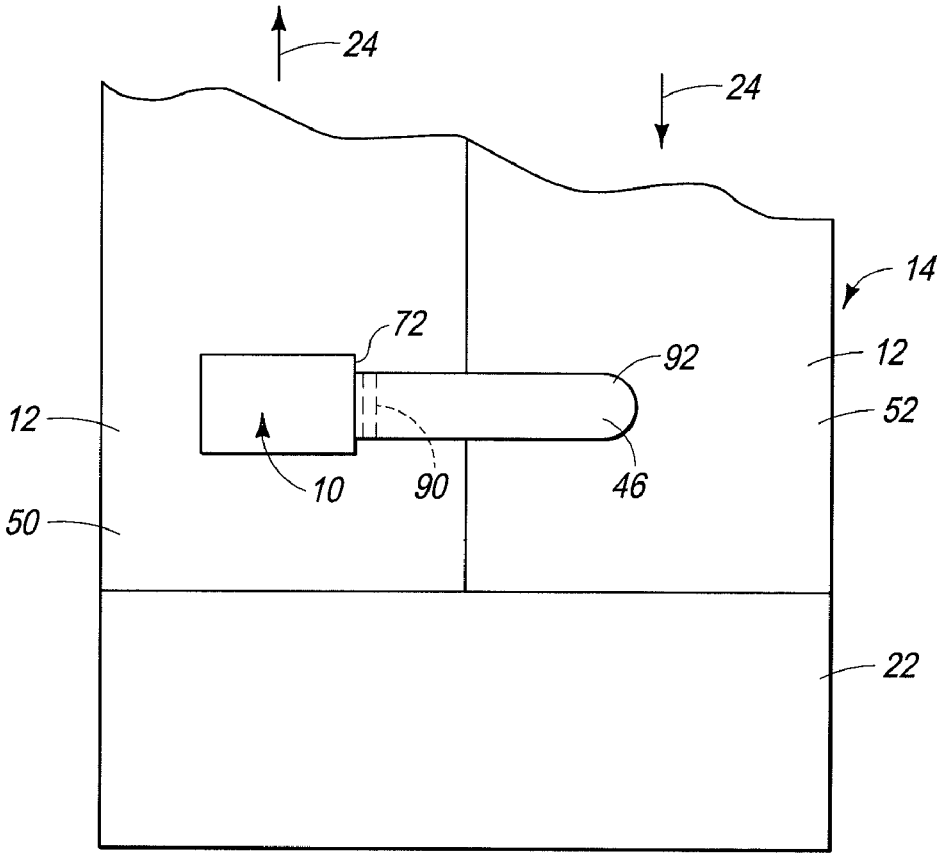
FIG. 1B is a side view, schematic drawing of the humidification system of FIG. 1A.

Referring to FIG. 1, a humidification system, generally 10, is shown installed into an air duct 12 of a heating system, generally 14, of a building (not shown). The heating system 14 includes a fan (not shown) and a furnace 22 for heating the building. Air flow direction is depicted by the direction of the arrows. Although this humidification system 10 could be used with an air conditioning system, it is generally not needed because warm outdoor air that is available during the cooling season holds more moisture than cold outdoor air available during the heating season.

Figure 2:
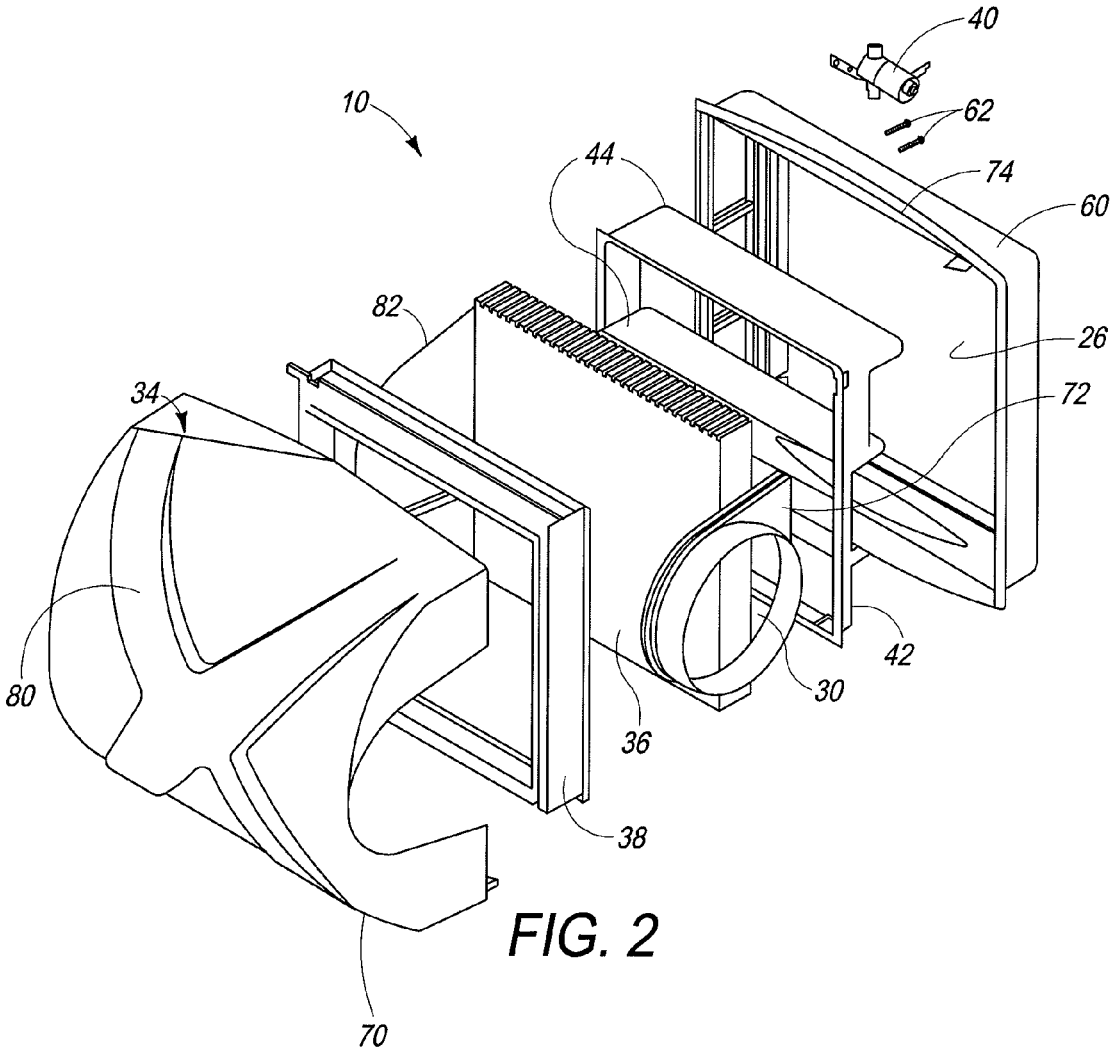
FIG. 2 is an exploded elevated perspective view of the humidification system of the present invention.

It is envisioned that the present humidification system 10 could be used with any heating system 14 that benefits from humidification of air 24 flowing through it, and wherein a pressure differential exists between two air passages capable of use with an air inlet 26 and air outlet 30 for the humidification system 10. The pressure differential must be sufficient to push a reasonable amount of unhumidified air 32 through the humidification system 10 for the intended purpose. The description that follows, in which the exemplary humidification system 10 is described as being used with a forced air furnace 14, is not intended to be limited to that application. Further, directional references made in the discussion that follows are to be interpreted as if the humidification system is oriented as shown in FIG. 2.

The humidification system 10 includes a housing, generally 34, an evaporative element 36, a pad holder 38, a means of controlling humidity output 40, a bypass frame 42 that includes a plurality of louvers 44 and an air return 46 (FIG. 1). Any material can be used to manufacture these parts as long as it does not rust and is strong enough to hold its shape under the pressure of the air in the forced air system. Typical materials include metals, such as aluminum, plastics, plastic including thermoplastics, or metal or plastic coated materials. Materials that are good choices for this application will not absorb or retain water that can breed molds or bacteria. At least one embodiment of this invention uses thermoplastic materials for the manufacture of the humidification system 10.

Referring to FIG. 1, the housing 34 is mountable to a surface of the air duct 12. In the example discussed below, the housing 34 is attachable to the air duct 12 on the high pressure side 50 of the pressure differential. In this case, the air return 46 directs air from the housing 34 to the low pressure air passage 52. Other piping arrangements that will be obvious to an artisan are contemplated for use with this invention.

In at least one embodiment, the housing 34 is mountable to the furnace 12 hot air duct or plenum 50. In order to mount the humidification system 10 it is necessary to cut at least first and second openings 54, 56 in the ducts 12. A base frame 60 is the portion of the housing that attaches the humidification system to the duct and defines the air inlet 26. A first opening 54 should be cut into the duct approximately the same size as the air inlet 26. The size and shape of the first opening 54 should substantially align with the base frame to minimize leakage of air where the duct and the base frame 60 meet. The base frame 60 is then mounted to the duct and secured thereto with fasteners 62, such as sheet metal screws. A square or round first opening 54 is used in at least some embodiments of the first opening to facilitate use of the humidification system 10 with either horizontal or vertical flow furnaces.

A second opening 56 is also needed for return of the humidified air 58 from an air return 46. As with the first opening 54, less leakage will be attained when the second opening 56 conforms closely to the size and shape of the air return 46. A round opening is used for the second opening 56 in some embodiments of this invention.

Parts of the housing 34 include the base frame 60, a cover 70 and at least one open end panel 72. The base frame 60 mounts to the first opening 54 in the air duct as discussed above. The cover 70 is attachable to the base frame 60 by any means of removably attaching it. Examples of means of removably attaching the cover is by use of removable fasteners, a ridge and groove (not shown) to attain a snap fit or a hinge and latch. Various fastening methods can also be used together, such as using a snap fit to hold parts in place then using auxiliary fasteners for strength.

The shape of the cover 70 should be such that, after flowing through the evaporative element 36, the air is channeled toward the air outlet 30. Some embodiments of the cover 70 are configured with a round shape to minimize dead spots, swirling the air around and out through the air outlet 30. The use of additional angled panels (not shown) to better direct the air flow toward the air outlet 30 are contemplated. As it is visible from the living space in the vicinity of the furnace, the cover 70 optionally includes design elements 80 that give it a pleasing appearance.

Air exits the housing 34 at the air outlet 30 in the open end panel 72. Preferably the open end panel 72 is a separate panel from the cover 30, however, the use of an integrated cover and open end panel is contemplated. The open end panel 72 is attachable to the air return 46 for directing the humidified air 58 to a furnace duct 52 of lower pressure than the hot air duct 50, to be circulated to the building. At least one embodiment of the open end panel 72 includes a flange for attachment to the air return 46. The open end panel 72 is positioned between the base frame 60 and the cover 70 and is removably attached to at least one of them.

A closed end panel 82 is optionally positioned opposing the open end panel 72. When present, it is designed to occupy the space opposite the open end panel 72 but includes no air outlet. As with the open end panel 72, it is contemplated that the closed end panel 82 can be either a separate part from the housing 34 or an integral part of the housing. Optionally, the closed end panel 82 includes design elements (not shown) to give it a pleasing appearance as viewed from the environment around the furnace.

At least one evaporative element 36 is positioned between the air inlet 26 and the air outlet 30. The pad holder 38 supports the evaporative element 36 and holds it in place. The evaporative elements 36 are well known in the art, for example slit and expanded metal pads that provides an evaporative surface for air flowing through the element. Alternative evaporative elements may be used, including wicking types. For the purposes of this application, the term "evaporative element" includes all devices for evaporating water to provide humidification. As air is directed over the evaporative element 36, water evaporates and becomes entrained in the air 24, thereby humidifying it. If more than one evaporative element 36 is present, any additional evaporative elements are also positioned to receive unhumidified air 32, not humidified air 58.

Preferably the air 24 is directed over the evaporative element 36 no more than one time. As the warm air is contacted with the water, heat from the air 24 is used to vaporize the water. Absorption of the heat of vaporization results in overall cooling of the air stream. Further, contact of the air with the housing 34 additionally cools the air since some of the heat transferred to the housing 34 will be lost to the ambient atmosphere. If the humidified air, which has now cooled to temperatures less than when it was first humidified, again passes through the evaporative element 36, it can lead to condensation of water rather then evaporation of water. Thus, passing the air through the evaporative element both entering and exiting the evaporative element, as shown in the prior art, can result in less humidity compared to a single pass.

The means for controlling humidity output controls the delivery of water to the evaporative element 36. For example, the moisture can be controlled via a solenoid operated water valve 40, thereby to attain and maintain a predetermined degree of relative humidity in the air being conducted by the furnace blower through the space to be heated. The control circuitry (not shown) for the humidifier preferably comprises a temperature sensor/transmitter unit (thermostat) and a humidity sensor/transmitter unit (humidistat) installed at an appropriate location or locations in the room or space heating and furnace system. Optionally, contained within the housing 34 is a wireless temperature receiving unit, a wireless humidity receiving unit, a transformer, a thermister and/or any suitable switches and electrical/electronic components (not shown) for operating the solenoid valve 40. As used herein the term "means for controlling humidity output" means any mechanical, electrical and/or electromechanical device or assembly for controlling humidity output of the humidifier, including but not limited to the aforesaid solenoid operated water valve 40 to selectively provide water to the evaporative element 36.

The plurality of louvers 44 is attached to the bypass frame 42, positioned at least partially within the air inlet 26. As shown, the louvers 44 are an integral part of the bypass frame 42, however attachment of individual louvers 44 is contemplated. The number of louvers 44 to be used is variable, depending on the physical size of the humidifying system, and the degree of humidification per pass that is desired. At least two louvers 44 are used, but the addition of more louvers 44 distributes the hot duct 50 air through a greater amount of the surface area of the evaporative element 36. As the number of louvers 44 increases, the humidification increases. The number of louvers is preferably between two and ten, or even greater.

Each of the louvers 44 directs a portion of the air from the hot air duct 50 to a section of the evaporative element 36. In some embodiments of this invention, the depth of the louvers 44 increases progressively moving along the bypass frame 42 in at least one direction. For example, when the bypass frame 42 is oriented as in FIG. 2, starting at the bottom of the bypass frame 42, the louvers 44 are graduated in size so that the louvers 44 extend deeper into the air duct 50 as the louver 44 is higher on the bypass frame 36. More specifically, the shallowest louvers 44 are encountered first by the air flow and the deepest louvers are the last ones in the direction of the air flow. Although the increase in depth need not be uniform between one louver 44 and the next, it is one option in selecting the depth of the louvers. Another method of selecting the size of the louvers 44 is to choose a size which results in uniform amounts of air being directed to the various portions of the evaporative element 36. Size and configuration of the louvers 44 may vary as long as they divert some of the air in the duct 50 through the humidifying system 10.

Figure 3:
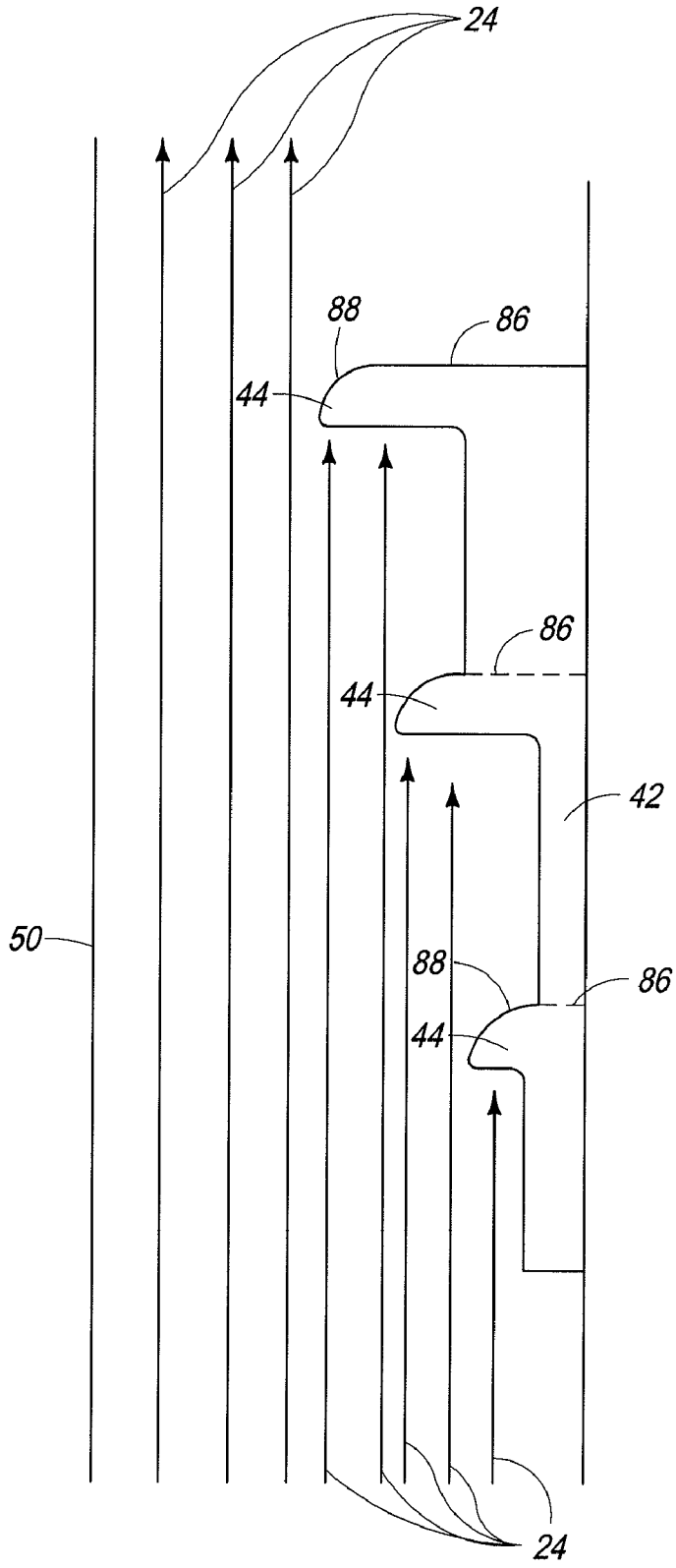
FIG. 3 is a side cutaway view of the air duct of FIG. 1A, showing the louvers in the duct.

The louvers 44 may be any shape that directs air into the humidifying unit. As shown in FIG. 3, louvers 44 that have a planar portion 86 and curved portion 88 are useful in redirecting the flow of air. This is a simplified drawing as actual air currents will be more complex. Each curved portion 88 scoops a portion of air 24 from the passing air stream. Then the portion of air passes over the straight portion 86 of the louver 44 which changes the motion of the portion of air from a circular motion like a whirlpool, to that of a straight air flow. By changing the momentum of the portion of air, it is more likely to flow straighter to the evaporative element 36 and reach the portion of the evaporative element at which it was directed. As shown in FIG. 2, the louvers 44 extend the entire width of the bypass frame 42, however, a louver 44 may also be used that extends into the hot air duct 50 over only part of its width.

The air return 46 provides a pathway for the humidified air exiting from the housing 34 and inserts it back into the hot air stream 50 for distribution to the building being heated. A first end 90 of the air return 46 attaches to the open end panel 72. A second end 92, opposing the first end, of the air return 46, attaches to the cold air duct 52 downstream of the humidifying system 10. Any size or shape duct can be used for the air return 46. An example of a useful and convenient material for the air return 46 is flexible metal tubing as is commonly used for venting a clothes dryer. The metal tubing 46 can be any diameter, however, many embodiments use metal tubing 46 having diameters of 4 inches or less to keep the humidified air flowing quickly through the air return 46. Use of wider tubing leads to low flow rates through the tubing, increasing cooling of the air and possible condensation of the water vapor.

As shown in FIG. 1, this humidification system 10 is oriented for use with a vertical flow furnace. Another embodiment of the invention has been modified for use with a horizontal flow furnace. The modifications include orienting the louvers 44 such that unhumidified 32 air is directed into the humidifier 10 and humidified air 58 is returned to the cold air duct 52.

A method for humidification includes withdrawing a plurality of portions of unhumidified air 32 from the hot air duct 50 using a plurality of louvers 44, each of which withdraws a portion of the unhumidified air 32 and directs it to the humidification system 10 generally described above. Each portion of unhumidified air is directed toward a portion of the evaporative element 36. The louvers 44 are shaped and positioned so that unhumidified air is directed across substantially all of the height and width of the evaporative element 36. This does not necessarily mean that every spot of the evaporative element 36 is engaged in humidification at all times. However, there are no large portions of the evaporative element 36 that are not being utilized for humidification of the unhumidified air 32.

Unhumidified air 32 is turned from the main flow of air by the louver 44 and flows into the humidification system 10 through the air inlet 26. The unhumidified air 32 then flows through the evaporative element 36 whereby it is humidified. Moisture is maintained on the evaporative element 36 by any known means. Examples of ways of maintaining moisture on the evaporative element 36 include wicking of water by the evaporative element 36, dripping or flow of water onto the evaporative element 36, preferably from above the evaporative element 36, spraying of water and dipping of at least a portion of the evaporative element 36 into water.

The humidity in the building is preferably controlled using a controlling device 40 such as a humidistat and solenoid valve. As long as the controlling device calls for additional humidity, the solenoid valve 40 remains open and moisture is maintained on the evaporative element 36. However, when the humidistat is satisfied, the solenoid valve 40 closes, stopping the flow of water. The evaporative element 36 is then allowed to become dry, no longer containing water to evaporate into the unhumidified air.

Only unhumidified air passes through the evaporative element 36. After passing through the evaporative element 36, the humidified air is channeled out of the evaporative element 36 to the air outlet 30. Air turbulence is preferably reduced by the shape of the housing 34. The humidified air 58 is then returned to a portion of an air duct 52 having a lower pressure than the first air duct 50.

While a particular embodiment of the apparatus and method for humidifying air has been shown and described, it will be appreciated by those skilled in the art that changes and modifications may be made thereto without departing from the invention in its broader aspects and as set forth in the following claims.

What is claimed is:

1. A humidification system for installation into an air duct of a forced air furnace, said humidification system comprising:

a housing mountable into the air duct, said housing including a base frame, a cover and at least one open end panel, wherein said base frame is mountable to an opening in the air duct, wherein the opening is shaped and configured to align with said base frame, wherein said cover is attachable to said base frame and configured to encourage flow of air from an air inlet to an air outlet; and wherein said open end panel is positionable between said base frame and said cover, and said open end panel includes an air outlet;

an evaporative element positioned between said air inlet and said air outlet;

a means for controlling humidity output;

a bypass frame comprising a plurality of louvers positioned at least partially within said air inlet, said louvers being sized and configured to extend at least partially into the air duct, said louvers being graduated in size so that the length of the louvers increases in the direction of the air flow; and an air return extending from said open end panel to said air duct.

2. The humidification system of claim 1, further comprising a closed end panel opposing said open end panel.

3. The humidification system of claim 1 wherein the number of said louvers is from about 2 to about 10.

4. The humidification system of claim 1, further comprising a holder for said evaporative element.

5. The humidification system of claim 1 wherein each of said louvers is at least partially planar and at least partially curved.

6. The humidification system of claim 1, wherein said louvers are distributed on said bypass frame such that air flowing from said louvers is directed at substantially the entire length and width of said evaporative element.

7. The humidification system of claim 1 wherein each of said louvers is spaced equidistantly from an adjacent one of said louvers within said bypass frame.

8. The humidification system of claim 1 wherein said housing snaps together using a ridge and groove system.

9. The humidification system of claim 1 wherein said air return comprises flexible tubing.

10. The humidification system of claim 1 wherein said means for controlling humidity output comprises a solenoid valve.

11. A method of humidifying air from an air duct of a forced air furnace, said method comprising:

withdrawing a plurality of portions of unhumidified air from a first air duct into a humidification system using a plurality of louvers, said humidification system comprising a housing, an air inlet and an air outlet, wherein said louvers extend into the air duct;

directing the unhumidified air through an evaporative element to produce humidified air, such that the unhumidified air is directed to substantially the entire height and width of said evaporative element;

maintaining moisture throughout the evaporative element;

channeling humidified air flowing out of said evaporative element to an air outlet; and returning the humidified air from the air outlet to a second air duct.

12. The method of claim 11 further comprising holding said evaporative element in place between said air inlet and said air outlet.

13. The method of claim 11 wherein said withdrawing further comprises diverting at least two sequential portions of the unhumidified air into the humidifying system.

* * * * *